US007530118B2

(12) United States Patent
Osborne et al.

(10) Patent No.: US 7,530,118 B2
(45) Date of Patent: May 12, 2009

(54) CAR SEAT SLIP SLEEP AND OUTER WEAR

(76) Inventors: Lisa A. Osborne, 249 S. Matthisen Ave., Compton, CA (US) 90220; Utte Osborne, 249 S. Matthisen Ave., Compton, CA (US) 90220

( * ) Notice: Subject to any disclaimer, the term of this patent is extended or adjusted under 35 U.S.C. 154(b) by 0 days.

(21) Appl. No.: 11/708,763

(22) Filed: Feb. 20, 2007

(65) Prior Publication Data

US 2008/0196141 A1 Aug. 21, 2008

(51) Int. Cl.
*A41B 13/06* (2006.01)

(52) U.S. Cl. ..... 2/69.5; 2/75; 2/111

(58) Field of Classification Search ..... 2/111, 2/78.2, 69.5, 75, 80, 83–86, 114, 69, 88, 2/93; 5/413 R, 655, 482, 486, 494, 505.1, 5/416, 603, 922, 923; 297/219.2, 465, 184.13, 297/467, 485

See application file for complete search history.

(56) References Cited

U.S. PATENT DOCUMENTS 1,343,038 A * 6/1920 Czechowicz ..... 2/78.2
1,758,740 A * 5/1930 Gale ..... 2/78.2
1,807,452 A * 5/1931 Swartz ..... 2/111
1,929,263 A * 10/1933 Sork ..... 2/69.5
2,675,557 A * 4/1954 Kempner, Jr. ..... 2/114
3,791,694 A 2/1974 Roberts et al.
4,241,458 A * 12/1980 Lesesne ..... 2/69.5
4,507,805 A * 4/1985 Calutoiu ..... 2/69.5
4,823,405 A 4/1989 Porter
4,993,090 A 2/1991 Ranalli
5,004,197 A 4/1991 Weekley
D321,599 S 11/1991 Takahashi et al.
5,243,724 A * 9/1993 Barnes ..... 5/482
5,437,061 A * 8/1995 Kenner ..... 2/69
5,611,095 A * 3/1997 Schneider ..... 5/482
5,692,257 A 12/1997 Albertieri
5,781,946 A * 7/1998 McEntire et al. ..... 5/482
5,897,164 A * 4/1999 Kagan et al. ..... 297/219.12
5,950,261 A 9/1999 Hay et al.
5,988,742 A * 11/1999 Stevens ..... 297/219.12
6,012,189 A * 1/2000 Dudley ..... 5/655
6,145,932 A * 11/2000 Hamel-Nyhus et al. ..... 297/465
6,272,683 B1 * 8/2001 Symms et al. ..... 2/69.5
6,401,248 B1 * 6/2002 Christensen ..... 2/69
6,764,134 B1 * 7/2004 Crescenzi et al. ..... 297/219.12
2004/0217633 A1 * 11/2004 Kassai et al. ..... 297/219.12
2005/0217004 A1 * 10/2005 Haberfeld ..... 2/69.5
2007/0061965 A1 * 3/2007 Crawford ..... 5/413 R

* cited by examiner

*Primary Examiner*—Amy B Vanatta

(57) ABSTRACT

Car Seat Slip Sleep and Outer Wear is a traditional sleep sack with an opening for passage of a safety strap. To use Car Seat Slip Sleep and Outer Wear, a user places the baby inside the garment and secures any flaps in place. When it is time to put the baby in the car seat, the flaps on the front and back of the garment, if present, can be undone, revealing the opening in the center of the garment. The baby is then positioned within the garment such that the opening can be utilized to secure the baby inside a car seat. The center strap of the car seat can be placed through the opening and between the baby's legs to secure the child in the car seat.

15 Claims, 1 Drawing Sheet

CAR SEAT SLIP SLEEP AND OUTER WEAR

CROSS REFERENCE TO RELATED APPLICATIONS

This United States Non-Provisional Patent Application does not claim priority to and United States Provisional Patent Applications or any foreign patent applications.

FIELD OF THE DISCLOSURE

The disclosures made herein relate generally to the child safety and clothing industry. The invention discussed herein is in the general classification of baby sleep sacks for use in cars.

BACKGROUND

Taking care of an infant is a huge responsibility. A baby depends on a parent or caregiver to meet all of his or her needs. Many new parents feel unprepared for this job and overwhelmed by the responsibility. The explosion of new products designed for babies and toddlers testifies to the desire of most parents to provide the best for their children. Consumers are looking for products that protect their children and make caring for infants and toddlers a little easier.

A child's safety is usually the area of greatest concern for many new parents. Parents and caregivers go to great lengths to ensure that infants and toddlers are raised in safe environments. Parents often install outlet protectors in their house to prevent a child from getting electrocuted. They also cushion corners of tables to prevent serious cuts and bruises and buy and install anchors to secure large pieces of furniture to the wall to prevent them from falling over on a child. Safety gates on stairwells and video and audio monitors to keep tabs on a baby at all times are also common features in many homes.

Car safety for an infant is an area of paramount concern for parents and caregivers. Most countries have passed laws requiring the operator of a motor vehicle with a child or infant inside to properly restrain the infant or child in an approved car seat or carrier. Child safety seats work by securing the child in a padded seat that has been sized to protect the child from being thrown loose in the event of an accident. One of two harness styles is commonly used to secure the child into the car seat—the five-point harness or the restraining bar. Both types of harness systems require that a strap pass between the legs of the child. One drawback to this center strap is that it can be difficult to secure the strap if the child is wearing bulky clothing. It is especially difficult to secure this strap if the child is wearing a one-piece sack style sleeper.

Many parents dress their children in sleep sacks because they help to keep the baby warm and also are more comfortable for the child since small children will often pull their legs up and out of the leg openings in standard sleepers and then are unable to get their legs back in the openings when they try to straighten them back out. The lack of leg openings in sleep sacks means that the only way to pass the center strap of the car seat between the child's legs is to draw the baby's legs up towards their chests which is both unsafe and uncomfortable for the child.

Hence, there is a need in the art for a safe, effective and cost efficient baby sleep sack with an opening through the front and back of the sack to permit a strap from a car seat to pass through it.

SUMMARY OF THE DISCLOSURE

Car Seat Slip Sleep and Outer Wear is a modification to the design of existing one-piece sleep sacks for infants or toddlers. Traditionally, sleep sacks consist of one large piece of fabric that is sewn in the shape of a traditional blanket sleeper with two long cuffed sleeves for the arms, a rounded neck opening and a bottom section that is rounded off to form a sack instead of having openings for the baby's legs and feet. The preferred embodiment of Car Seat Slip Wear will have an opening through approximately the middle or lower third of the sleep sack to permit a strap from a car seat harness to pass through the sack along with other features described herein.

The principal object of this invention is to provide a garment that has an opening to permit a seat belt buckle or other harness to pass through it.

Another object of this invention is to provide a garment that will allow easier diaper changing or clothing changes through the use of a bottom flap.

Another object of this invention is to provide a garment that is comfortable and safe to use for a baby in a car seat.

Another object of this invention is to provide an affordable garment for use with a baby seat.

Another object of this invention is to provide an aesthetically pleasing garment that can be used to cover a baby and place him in a car seat.

Another object of this invention is to provide a garment for use with a blanket or other covering material.

Yet another object of this invention is to provide a baby garment that is convenient to use.

DETAILED DESCRIPTION OF THE DRAWINGS

The preferred embodiment of Car Seat Slip Sleep and Outer Wear is comprised of at least some of the following: a traditional sleep sack with a centrally located opening for passage of a safety strap.

Figure 1:
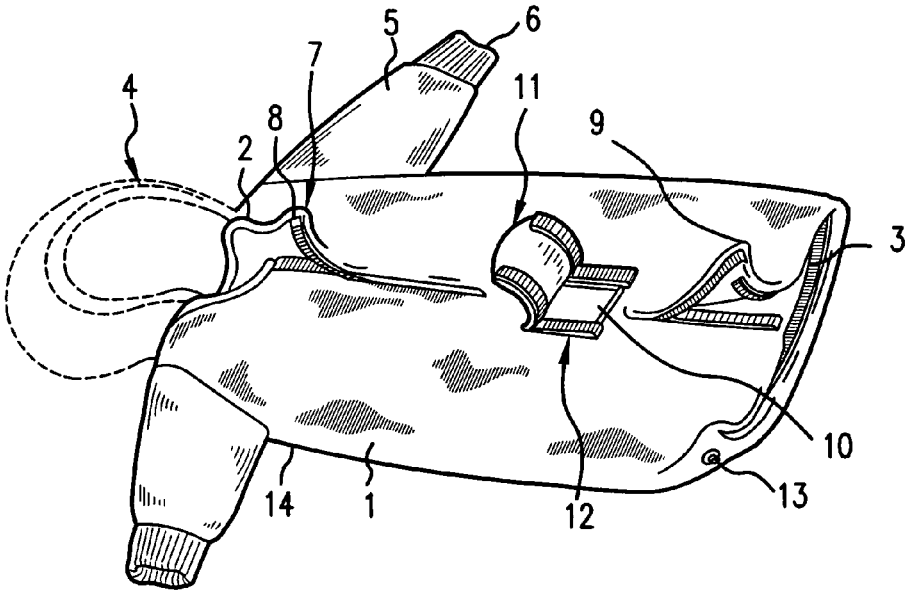
FIG. 1 depicts a perspective view of the preferred embodiment of the invention.

In the preferred embodiment of the invention, shown in FIG. 1, a garment 1 has a collar opening 2 at the top and a bottom that closes by a velcro arrangement 3 lining the interior of both sides of the garment 1. The garment 1 is made of fleece. Though a variety of fabrics may be used, fleece is used in the preferred embodiment due to its warmth and softness. A hood 4 attaches to the top of the garment 1 and will also be made of fleece in this preferred embodiment. Sleeves 5 with cuffs 6 attach to either side of the garment 1 to accommodate an infant's arms.

A top flap 7 with a velcro attaching mechanism 8 is located on the front of the garment 1 and extends to approximately the center of the garment 1. A bottom flap 9 also utilizing a velcro attaching mechanism provides additional ventilation inside the garment 1. The bottom flap 9 also provides for easy changing of clothing or a diaper without having to remove the entire garment 1. This particularly useful during winter months when removing the garment 1 would expose the baby to the cold.

A cooling mechanism 14 consisting of velcro around the shoulder area and extending to the hip area of the garment 1 allow the front of the garment 1 to be folded down to the hip area to cool the user when appropriate.

An opening 10 is located approximately one third of the way from the bottom of the garment 1 and extends through the front and back of the garment. A flap 11 utilizing a velcro attaching mechanism 12 is located on the front of the garment 1. A similar flap arrangement is also present on the back of the garment 1.

A set of button holes 13 located on the rear and bottom of the garment 1 that correspond in size and shape to snaps located on a blanket (not pictured in FIG. 1) permit additional insulation to be attached to the garment for the baby's comfort. The blanket could be of any width or thickness.

Pastel colors and bright primary shades are the preferred color choice for the fleece garment though any color or design could be utilized. The invention would come in a variety of sizes and could alternatively include hand warmers at the end of the sleeves or cuffs to provide warmth for the baby's hands.

Figure 2:
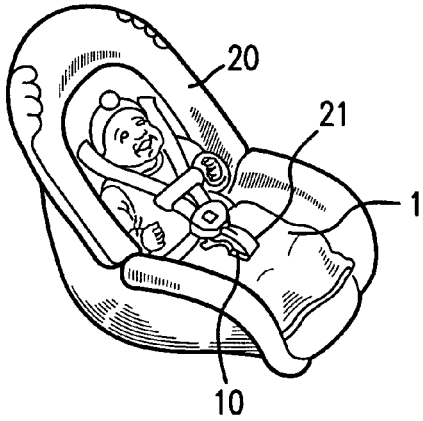
FIG. 2 depicts a perspective view of the preferred embodiment of the invention as it is being used on a baby and in a car seat.

FIG. 2 depicts the preferred embodiment of the invention as it is in place on the baby and in a car seat 20. A center strap 21 can be seen protruding through the opening 10 of the garment 1.

Figure 3:
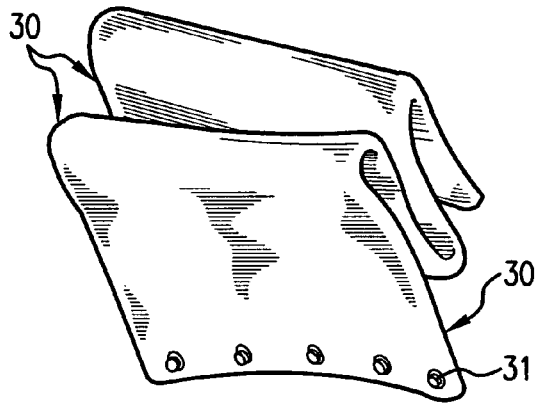
FIG. 3 depicts a perspective view of an additional blanket to be used in conjunction with the preferred embodiment of the invention.

FIG. 3 shows a perspective view of the blanket 30 to be used in conjunction with the set of button holes described in relation to FIG. 1. The snaps 31 are located on one end of the blanket 30 and are designed to attach to the button holes on the rear and bottom of the garment. The blanket 30 can then be placed over the baby for additional padding.

To use Car Seat Slip Sleep and Outer Wear, a user places the baby inside the garment and secures all of the flaps in place using the velcro attaching mechanisms. If desired, the additional blanket can also be attached using the button holes and corresponding snaps. When it is time to put the baby in the car seat, the centrally located flaps on the front and back of the garment can be undone, revealing the opening in the center of the garment. The baby is then positioned within the garment such that the opening can be utilized to secure the baby inside a car seat. The center strap of the car seat can be placed through the opening and between the baby's legs to secure the child in the car seat.

The components of Car Seat Slip Sleep and Outer Wear may vary widely but may include plastic, textiles, elastic, velcro and other components.

The plastic used in the production will ideally be selected for durability and longevity. Thermoplastics are commonly used in the manufacturing of components similar to those used in this invention. Polyethylene, polypropylene, and other similar thermoplastic materials would be among those with the necessary traits. Members of this family are recognized universally as being versatile and of high quality.

The plastic components of Car Seat Slip Sleep and Outer Wear can also be formed with the use of plastic molding techniques, such as injection molding or blow molding. Injection molding requires melted plastic to be forcefully injected into relatively cool molds. As the plastic begins to harden, it takes on the shape of the mold cavity. This technique is ideal for the mass production of products. Alternatively, blow molding, a form of extrusion, could be utilized. Blow molding involves a molten tube being pushed into a mold. Compressed air then forces the molten tube against the cold walls of the mold.

It should be obvious that the present invention can be of various shapes and sizes. It should also be obvious that the components of the invention can be made of different types of plastics or other suitable materials and can be of any color. The materials chosen for the garment will vary widely and should be chosen to correspond with the weather. A waterproof fabric could be used for when snow or rain is present. A warmer fabric could be used for colder weather and a lighter weight fabric for warmer weather. The velcro hook and loop attaching mechanisms utilized in the preferred embodiment could be replaced with alternative attaching mechanisms. For example, a hook and loop, snaps, button and hole or zipper and guide could be utilized. While this invention is designed for use with car seats, it could be used in any situation in which a strap or device must be placed between an infant's legs such as at a park or other playground.

It will be recognized by those skilled in the art that changes or modifications may be made to the above-described embodiments without departing from the broad inventive concepts of the invention. It should therefore be understood that this invention is not limited to the particular embodiments described herein, but is intended to include all changes and modifications that are within the scope and spirit of the invention as set forth in the claims.

What is claimed is:

1. A garment comprising:

(a) a collar opening at the top of the garment;

(b) a closed bottom of the garment extending across the garment secured via a hook and a loop fastener;

(c) an opening located at the middle of the garment and extending through the front and the back of the garment;

(d) a hood attached to the top and back of the garment;

(e) a first sleeve and a second sleeve on opposite sides of the garment (f) a first cuff on the first sleeve and a second cuff on the second sleeve;

(g) a top flap with a first hook and loop attaching mechanism located on the front of the garment and a bottom flap utilizing a second hook and loop attaching mechanism also located on the front of the garment (h) a first flap with a hook and loop attaching mechanism located on the front of the garment and a second flap with a hook and loop attaching mechanism located on the back of the garment that cover the opening in the middle of the garment;

(i) a blanket having snaps thereon;

(j) a set of button holes located across the back and bottom of the garment that correspond in size and shape to said snaps on said blanket;

(k) a cooling mechanism on the top and front of the garment to allow the garment to fold; and (l) said garment and said hood being made of fleece.

2. A garment adapted to be used for seating infants in a car seat, the garment comprising:

(a) a front face and a back face extending generally vertically, the front face is attachable to the back face, (b) a collar opening for receiving the head of the infant;

(c) side openings for receiving the arms of the infant;

(d) a closeable bottom for receiving the legs of the infant;

(e) an opening in the front face and extending through the back face for passing through a strap from a car seat belt for buckling the infant:

(f) a first flap located on the front face of the garment and a second flap located on the back face of the garment that cover the opening: and (g) a set of button holes located on the bottom of the garment that correspond in size and shape to a ret of snaps located on a blanket.

3. The garment of claim 2 wherein the opening is closeable.

4. The garment of claim 2 wherein a portion of the front face located in proximity of the bottom is moveable to enable changing clothing and diaper of the infant without having to remove the entire garment.

5. The garment of claim 2 wherein a top portion of the front face is moveable to enable cooling of the infant.

6. The garment of claim 2 wherein the bottom is adapted to be attached to a blanket.

7. The garment of claim 2 wherein the bottom is selectively closeable to enable warming of the infant.

8. A garment adapted to be used for seating infants in a car seat, the garment comprising:

(a) a front face and a back face extending generally vertically, the front face is attachable to the back face, (b) a collar opening for receiving the gead of the infant;

(c) side openings for receiving the arms of the infant;

(d) a closeable bottom for receiving the legs of the infant, wherein the bottom is adaptable to be attached to a blanket;

(e) an opening in the front face and extending through the back face for passing through a strap from a car seat belt for buckling the infant;

(f) a first flap located on the front face of the garment and a second flap located on the back face of the garment that coves the opening; and (g) a set of button holes located on the bottom of the garment that correspond in size and shape to a set of snaps located on a blanket.

9. The garment of claim 8 wherein the opening is closeable.

10. The garment of claim 8 wherein a portion of the front face is moveable to enable changing clothing and diaper of the infant without having to remove the entire garment.

11. The garment of claim 8 wherein a top portion of the front face is moveable to enable cooling of the infant.

12. The garment of claim 8 wherein the bottom is selectively closeable to enable warming of the infant.

13. A garment adapted to be used for seating infants in a car seat, the garment comprising:

(a) a front face and a back face extending generally vertically, the front face is attachable to the back face, and wherein a portion of the front face is moveable;

(b) a collar opening for receiving the gead of the infant;

(c) side openings for receiving the arms of the infant;

(d) a closeable bottom for receiving the legs of the infant;

(e) an opening in the front face and extending through the back face for passing through a strap from a car seat belt for buckling the infant;

(f) a first flap located on the front face of the garment and a second flap located on the back face of the garment that cover the opening; and (g) a set of button holes located on the bottom of the garment that correspond in size and shape to a set of snaps located on a blanket.

14. The garment of claim 13 wherein the bottom is adapted to be attached to a blanket.

15. The garment of claim 13 wherein the bottom is selectively closeable to enable warming of the infant.

* * * * *